US012484667B2

(12) United States Patent
Suzuki

(10) Patent No.: US 12,484,667 B2
(45) Date of Patent: Dec. 2, 2025

(54) SHOE COMPONENT AND SHOE

(71) Applicant: ASICS CORPORATION, Kobe (JP)

(72) Inventor: Chihaya Suzuki, Hyogo (JP)

(73) Assignee: ASICS CORPORATION, Kobe (JP)

( * ) Notice: Subject to any disclaimer, the term of this patent is extended or adjusted under 35 U.S.C. 154(b) by 241 days.

(21) Appl. No.: 17/936,257

(22) Filed: Sep. 28, 2022

(65) Prior Publication Data

US 2023/0115950 A1 Apr. 13, 2023

(30) Foreign Application Priority Data

Oct. 1, 2021 (JP) ..... 2021-162466

(51) Int. Cl.
*A43B 23/26* (2006.01)

(52) U.S. Cl.
CPC ..... *A43B 23/26* (2013.01)

(58) Field of Classification Search
CPC ..... A43B 23/26; A43B 23/045; A43C 7/00
See application file for complete search history.

(56) References Cited

U.S. PATENT DOCUMENTS 39,163 A * 7/1863 Newton ..... A43C 7/00 24/712
2,007,157 A 7/1935 Cockrum
4,053,995 A * 10/1977 Shein ..... A43B 7/14 36/88
5,416,987 A * 5/1995 Bemis ..... A43B 11/00 36/50.1
8,375,602 B2 * 2/2013 Takada ..... A43B 7/1495 36/50.1
10,219,580 B2 * 3/2019 Taylor ..... A43C 11/22
2010/0205832 A1 * 8/2010 Takada ..... A43C 1/00 36/50.1

(Continued)

FOREIGN PATENT DOCUMENTS

DE 10 2005 056573 B3 1/2007
DE 10 2020 124000 A1 3/2021
FR 2 448 871 A1 9/1980

(Continued)

OTHER PUBLICATIONS

The extended European search report issued by the European Patent Office on Feb. 3, 2023, which corresponds to European Patent Application No. 22197304.3-1015 and is related to U.S. Appl. No. 17/936,257.

(Continued)

*Primary Examiner* — Jillian K Pierorazio
(74) *Attorney, Agent, or Firm* — Studebaker Brackett PLLC

(57) ABSTRACT

A shoe component includes a tongue covering an instep of a foot of a wearer, a medial wing covering a medial midfoot of the wearer, and a lateral wing covering a lateral midfoot of the wearer, in which a part of the tongue on a medial foot side from a center in a foot width direction and the medial wing constitute a medial-foot tongue portion, a part of the tongue on a lateral foot side from the center in the foot width direction and the lateral wing constitute a lateral-foot tongue portion, and at least one of the medial-foot tongue portion and the lateral-foot tongue portion is provided with a tongue eyelet through which a shoelace is threaded.

9 Claims, 7 Drawing Sheets

(56) References Cited

U.S. PATENT DOCUMENTS

| | | | | |
|---|---|---|---|---|
| 2021/0106098 | A1* | 4/2021 | Kajiwara | A43B 23/027 |
| 2021/0251342 | A1* | 8/2021 | Koo | A43C 1/04 |

FOREIGN PATENT DOCUMENTS

| | | | | |
|---|---|---|---|---|
| GB | 2 043 429 | A | | 10/1980 |
| GB | 2043429 | | * | 10/1980 |
| JP | H05-084209 | U | | 11/1993 |
| JP | 2005-046520 | A | | 2/2005 |
| JP | 5444558 | B2 | | 3/2014 |

OTHER PUBLICATIONS

An Office Action; "Notice of Reasons for Refusal," mailed by the Japanese Patent Office on Jun. 24, 2025, which corresponds to Japanese Patent Application No. 2021-162466 and is related to U.S. Appl. No. 17/936,257; with English language translation.

* cited by examiner

SHOE COMPONENT AND SHOE

CROSS-REFERENCE TO RELATED APPLICATIONS

The present application claims priority to and incorporates by reference the entire contents of Japanese Patent Application No. 2021-162466 filed in Japan on Oct. 1, 2021.

BACKGROUND OF THE INVENTION

1. Field of the Invention

The present invention relates to a shoe component to be used for an upper of a shoe and a shoe including the upper using the shoe component.

2. Description of the Related Art

A shoe includes an upper that covers a foot of a wearer, and a sole that covers the sole of the foot of the wearer. When the wearer kicks the ground during walking or running, the MP joint of the foot of the wearer flexes, and the foot of the wearer tends to escape from the upper. Therefore, the upper of the shoe is required to fit the foot of the wearer and to prevent the foot of the wearer from escaping even if the MP joint of the foot of the wearer flexes at the time of kicking the ground.

In order to enhance the fit of an upper to the foot of a wearer, a lacing fitting structure is provided on the upper. JP 5444558 B discloses a shoe in which eyelets are provided on a side panel that is not surface-jointed to an exterior material of a main upper. The shoe disclosed in JP 5444558 B allows a wearer to select whether to fit the side panel or to fit both the side panel and the main upper to the foot of the wearer in order to adjust the fit according to the preference of the wearer.

A shoe having a lacing fitting structure includes a tongue that covers an instep of a foot of a wearer. The shoe disclosed in JP 5444558 B cannot adjust the fit of the tongue to the instep of the foot of the wearer, and there is room for further improving the fit to the foot of the wearer.

The present invention has been made in view of the above, and a purpose of the present invention is to obtain a shoe component capable of forming an upper that is highly fitted to a foot of a wearer.

SUMMARY OF THE INVENTION

A shoe component according to one aspect of this disclosure includes a tongue covering an instep of a foot of a wearer; a medial wing covering a medial midfraot of the wearer; and a lateral wing covering a lateral midfoot of the wearer. A part of the tongue on a medial foot side from a center in a foot width direction and the medial wing constitute a medial-foot tongue portion. A part of the tongue on a lateral foot side from the center in the foot width direction and the lateral wing constitute a lateral-foot tongue portion. The medial-foot tongue portion and the lateral-foot tongue portion are each provided with one or more of a plurality of tongue eyelets through which a shoelace is threaded. A number of the tongue eyelets provided in the medial-foot tongue portion is different than a number of the tongue eyelets provided in the lateral-foot tongue portion. The foregoing and other features, aspects, and advantages of the present disclosure will become more apparent from the following detailed description of the present disclosure when taken in conjunction with the accompanying drawings.

DETAILED DESCRIPTION OF THE PREFERRED EMBODIMENTS

Hereinafter, embodiments of a shoe component and a shoe according to the present invention will be described in detail with reference to the drawings. Note that the present invention is not limited by the embodiments. In the following embodiments, the same or common parts are denoted by the same reference signs, and the description thereof will not be repeated.

In the following embodiments, a direction in which a heel center axis, which is a perpendicular line passing through the heel center of a sole in a plan view of a shoe, extends is referred to as a front-rear direction, and a direction orthogonal to the front-rear direction in a plan view of the shoe is referred to as a foot width direction.

In addition, a direction from the heel toward the toe of the shoe in the front-rear direction is referred to as a front, and a direction from the toe toward the heel of the shoe in the front-rear direction is referred to as a rear.

In addition, a median side of a foot in the anatomical position is referred to as a medial foot side, and the side opposite to the median side of the foot in the anatomical position is referred to as a lateral foot side. That is, the side closer to the median line in the anatomical position is referred to as the medial foot side, and the side farther from the median line in the anatomical position is referred to as the lateral foot side.

Furthermore, a height direction means a direction orthogonal to both the front-rear direction and the foot width direction unless otherwise specified, and a thickness means a dimension in the height direction unless otherwise specified.

First Embodiment

Figure 1:
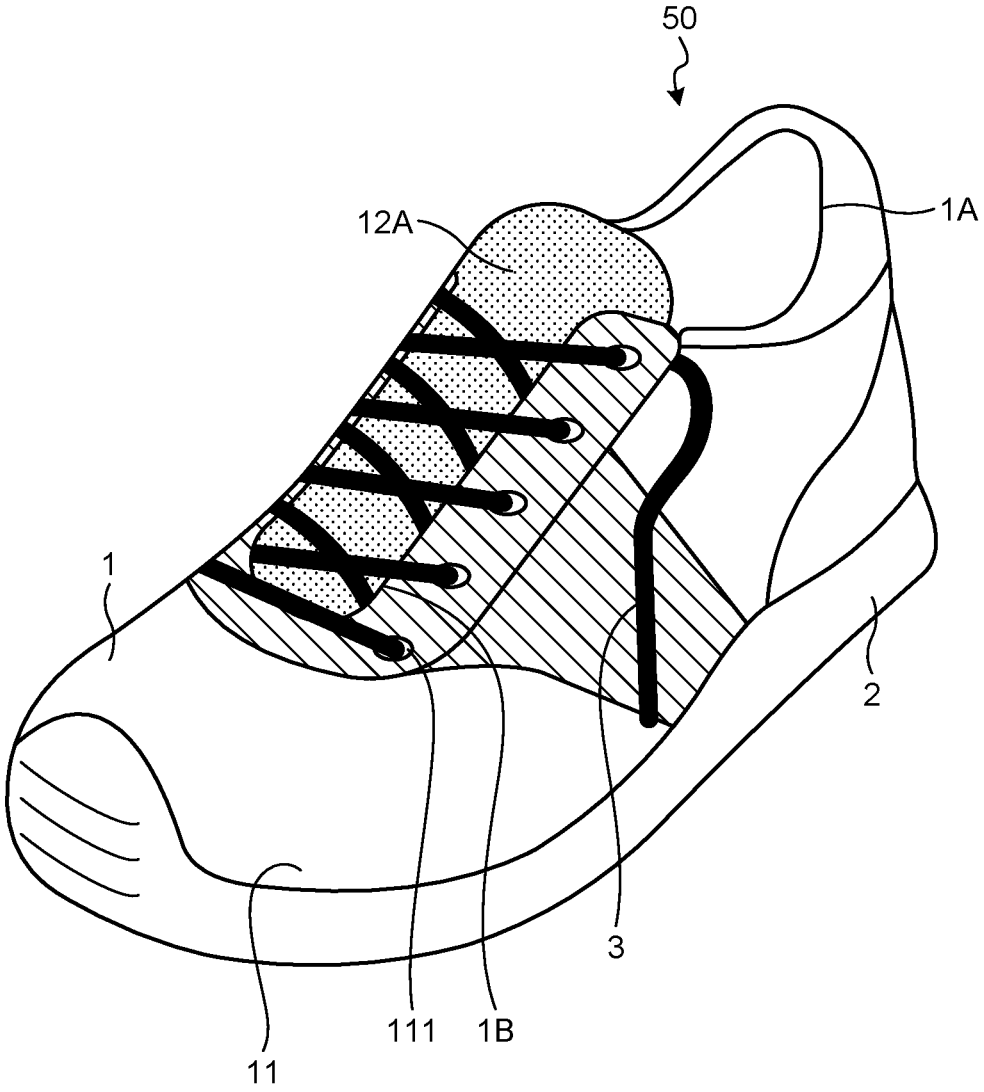
FIG. 1 is a perspective view of a shoe according to a first embodiment of the present invention.

FIG. 1 is a perspective view of a shoe according to a first embodiment of the present invention. A shoe 50 includes an upper 1 that covers a foot of a wearer, and a sole 2 that covers a sole of the foot of the wearer. The upper 1 includes a main upper 11 that covers the forefoot, the midfoot, and the heel of the wearer, and a shoe component 12A that covers the instep of the foot of the wearer.

The main upper 11 is formed with a first opening 1A into which the foot of the wearer is inserted and a second opening 1B connected to the first opening 1A in front of the first opening 1A. The main upper 11 is provided with upper eyelets 111 through which a shoelace 3 is threaded at an edge of the second opening 1B. The main upper 11 includes an insole that is not illustrated.

Figure 2:
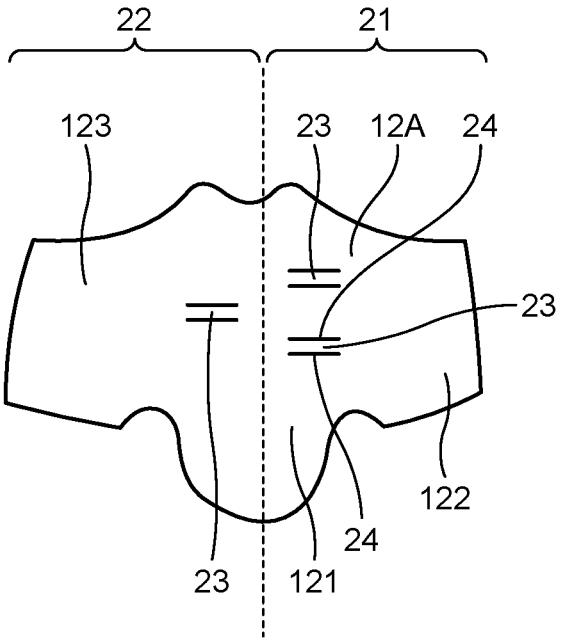
FIG. 2 is a plan view of a shoe component according to the first embodiment.

FIG. 2 is a plan view of the shoe component according to the first embodiment. The shoe component 12A includes a tongue 121 that covers the instep of the foot of the wearer, a medial wing 122 that covers the medial midfoot of the wearer, and a lateral wing 123 that covers the lateral midfoot of the wearer. A part of the tongue 121 on the medial foot side from the center in the foot width direction and the medial wing 122 constitute a medial-foot tongue portion 21. The medial wing 122 is a tongue-shaped member extending from the tongue 121 to protrude toward the medial foot side in the foot width direction. In addition, a part of the tongue 121 on the lateral foot side from the center in the foot width direction and the lateral wing 123 constitute a lateral-foot tongue portion 22. The lateral wing 123 is a tongue-shaped member extending from the tongue 121 to protrude toward the lateral foot side in the foot width direction. The medial-foot tongue portion 21 and the lateral-foot tongue portion 22 are provided with tongue eyelets 23 through which the shoelace 3 is threaded. The shoe component 12A may include the medial wing 122 and the lateral wing 123 that are seamlessly connected to the tongue 121 or include the medial wing 122 and the lateral wing 123 that are separate members and sewn to the tongue 121.

The tongue eyelets 23 are provided in a part of the tongue 121 on the medial foot side from the center in the foot width direction and a part of the tongue 121 on the lateral foot side from the center in the foot width direction. The tongue eyelets 23 include two tongue eyelets provided in the medial-foot tongue portion 21 and one tongue eyelet provided in the lateral-foot tongue portion 22. The tongue eyelets 23 formed in the medial-foot tongue portion 21 and the tongue eyelet 23 formed in the lateral-foot tongue portion 22 are alternately arranged in the front-rear direction. The shoe component 12A is formed of a material having different stretchability from the main upper 11.

The tongue 121, the medial wing 122, and the lateral wing 123 each have an outer surface material serving as an outer surface and an inner surface material serving as an inner surface. The inner surface is a surface that contacts the foot of wearer, and the outer surface is a surface on the back side of the inner surface. Each tongue eyelet 23 is formed by a part of the outer surface material sandwiched between slits 24 formed in parallel in the outer surface material. In the tongue eyelet 23, the shoelace 3 is drawn between the outer surface material and the inner surface material through one slit 24, and the shoelace 3 is drawn out from between the outer surface material and the inner surface material through the other slit 24. By using a part of the outer surface material of the shoe component 12A as the tongue eyelet 23, it is possible to achieve a parts-less structure as compared with a structure in which ring-shaped components are attached to the outer surface material to form the tongue eyelet 23. However, the tongue eyelet 23 is not limited to the part sandwiched between the slits 24 formed in parallel in the outer surface material. That is, a ring-shaped component may be attached to each of the medial-foot tongue portion 21 and the lateral-foot tongue portion 22 to be used as the tongue eyelet 23. The slits 24 extend in the foot width direction. Since the slits 24 extend in the foot width direction, it is possible to reduce resistance when the shoelace 3 is threaded through the tongue eyelets 23. Note that, the slits 24 may extend in the front-rear direction.

Figure 3:
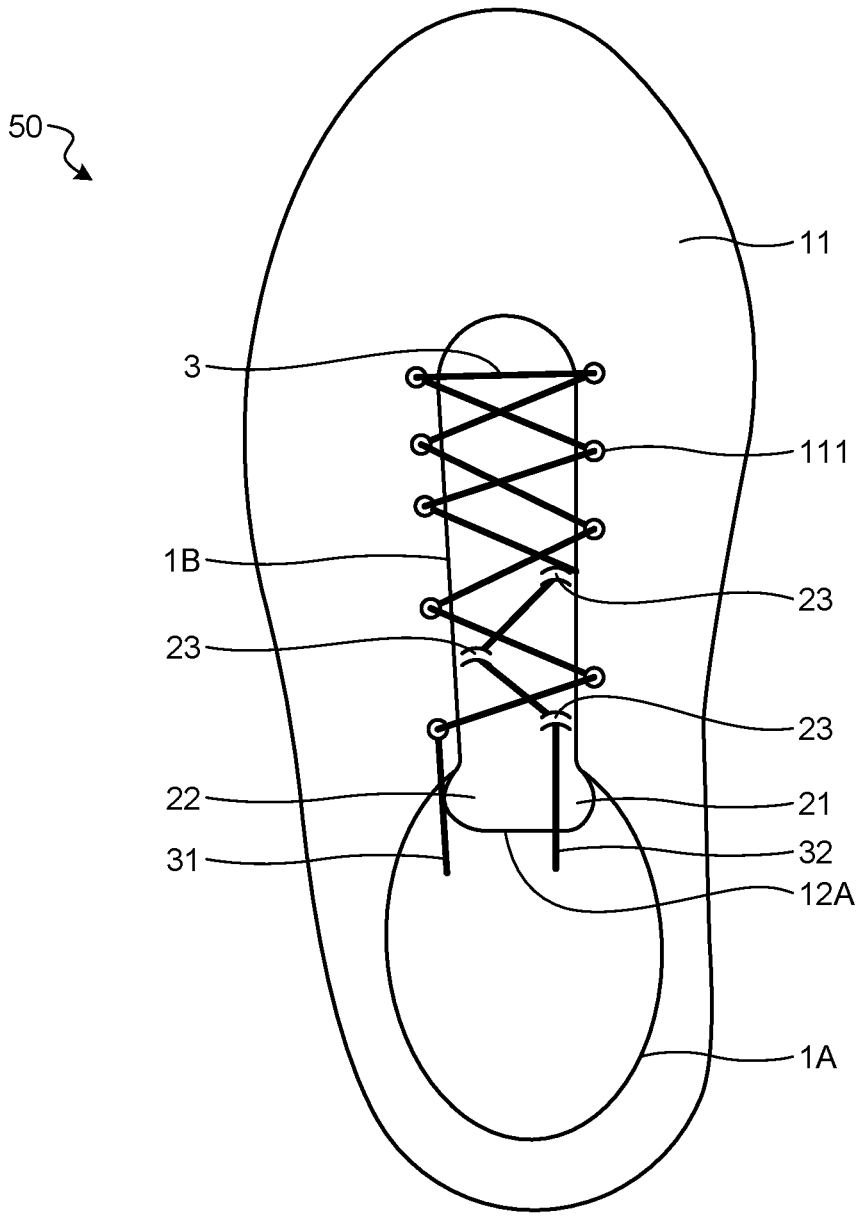
FIG. 3 is a top view of the shoe according to the first embodiment.

FIG. 3 is a top view of the shoe according to the first embodiment. As described above, the upper eyelets 111 are provided at the edge of the second opening 1B of the main upper 11, but no upper eyelet 111 is provided at the same position at the edge on the medial foot side of the second opening 1B in the front-rear direction as the tongue eyelet 23 provided in the medial-foot tongue portion 21. In addition, no the upper eyelet 111 is provided in the main upper 11 at the same position at the edge on the lateral foot side of the second opening 1B in the front-rear direction as the tongue eyelet 23 provided in the lateral-foot tongue portion 22. The shoelace 3 is alternately threaded through the tongue eyelets 23 provided in the medial-foot tongue portion 21 and the tongue eyelet 23 provided in the lateral-foot tongue portion 22, and then threaded through the upper eyelets 111. Here, when the shoelace 3 is divided into two parts from an intermediate point between a part threaded through the foremost upper eyelet 111 on the medial foot side and a part threaded through the foremost upper eyelet 111 on the lateral foot side, a half threaded through only the upper eyelets 111 is referred to as a first part 31, and the other half passing through the upper eyelets 111 and the tongue eyelets 23 is referred to as a second part 32.

Figure 4:
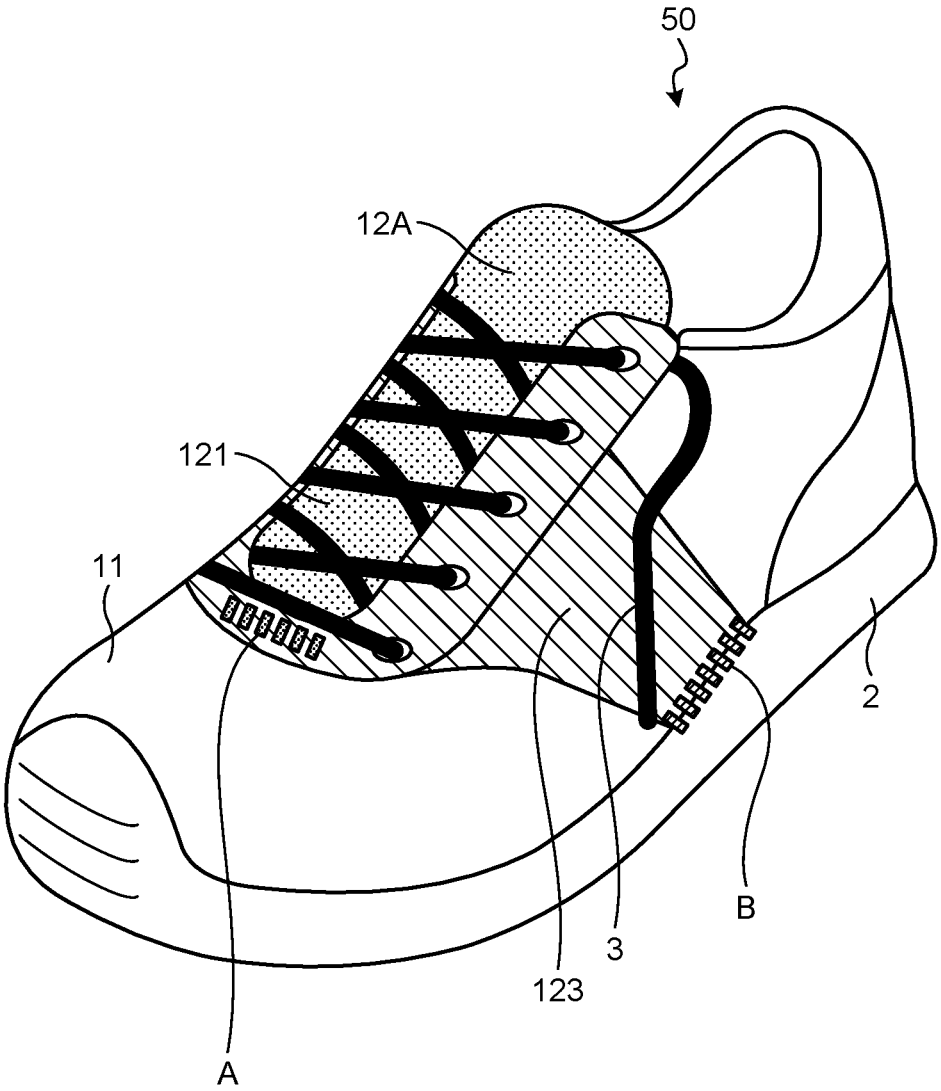
FIG. 4 is a view showing a fixed state of a shoe component, a main upper, and a sole according to the first embodiment.

FIG. 4 is a view showing a fixed state of the shoe component, the main upper, and the sole according to the first embodiment. The front edge of the tongue 121 of the shoe component 12A is connected to the front edge of the second opening 1B of the main upper 11 by sewing or welding. The tip of the lateral wing 123 of the shoe component 12A is sewn to the lower end of the midfoot portion of the main upper 11 and the insole. The reference sign A in FIG. 4 shows a position where the front edge of the tongue 121 of the shoe component 12A is sewn to the front edge of the second opening 1B of the main upper 11. The reference sign B in FIG. 4 shows a position where the tip of the lateral wing 123 of the shoe component 12A is sewn to the lower end of the midfoot portion of the main upper 11 and the insole. Although not illustrated in FIG. 4, the tip of the medial wing 122 of the shoe component 12A is sewn to the lower end of the midfoot portion of the main upper 11 and the insole. Therefore, the shoe component 12A forms an arch in the foot width direction.

When the wearer wears the shoe 50 and then pulls the first part 31 of the shoelace 3, the edge on the medial foot side and the edge on the lateral foot side of the second opening 1B of the main upper 11 are drawn toward the center in the foot width direction, and the main upper 11 tightens the foot of the wearer from the foot width direction. On the other hand, when the wearer pulls the second part 32 of the shoelace 3, the edge on the medial foot side and the edge on the lateral foot side of the second opening 1B of the main upper 11 are drawn toward the center in the foot width direction, and the medial-foot tongue portion 21 and the lateral-foot tongue portion 22 of the shoe component 12A are also drawn toward the center in the foot width direction. Since the tips of the medial wing 122 and the lateral wing 123 of the shoe component 12A are sewn to the insole, when the medial-foot tongue portion 21 and the lateral-foot tongue portion 22 are drawn toward the center in the foot width direction, the arch formed by the shoe component 12A is lowered, and the shoe component 12A holds the instep of the foot of the wearer. Therefore, when the second part 32 of the shoelace 3 is pulled, the shoe component 12A holds the instep of the foot of the wearer, and the main upper 11 tightens the foot of the wearer from the foot width direction. Since the shoe component 12A is formed of a material having different stretchability from the main upper 11, the wearer feels a difference in the hold on the foot when the first part 31 of the shoelace 3 is pulled and when the second part 32 is pulled.

In the shoe component 12A according to the first embodiment, the number of the tongue eyelets 23 of the medial-foot tongue portion 21 is greater than the number of the tongue eyelets 23 of the lateral-foot tongue portion 22. For this reason, when the second part 32 of the shoelace 3 is pulled, the medial-foot tongue portion 21 is more strongly drawn to the center in the foot width direction than the lateral-foot tongue portion 22. Therefore, the shoe 50 using the shoe component 12A according to the first embodiment can hold the foot of the wearer on the medial foot side more strongly than on the lateral foot side when the second part 32 of the shoelace 3 is pulled.

In this manner, the shoe 50 using the shoe component 12A according to the first embodiment fits the foot of the wearer differently when the first part 31 of the shoelace 3 is pulled and when the second part 32 is pulled. Therefore, the wearer of the shoe 50 using the shoe component 12A according to the first embodiment can wear the shoe with the tightness that suits the preference of the wearer. In addition, since the shoe component 12A according to the first embodiment includes the medial wing 122 and the lateral wing 123 in addition to the tongue 121, the shoe component 12A can hold the instep of the foot of the wearer in a wrapping manner. In this manner, by using the shoe component 12A according to the first embodiment, it is possible to form the upper 1 that is highly fitted to the foot of the wearer.

Although the structure in which two tongue eyelets 23 are provided in the medial-foot tongue portion 21 and one tongue eyelet 23 is provided in the lateral-foot tongue portion 22 has been exemplified, the number of tongue eyelets is not limited to the exemplified numbers. For example, the number of tongue eyelets 23 can be different from the exemplified numbers, such as three tongue eyelets in the medial-foot tongue portion 21 and two tongue eyelets in the lateral-foot tongue portion 22.

Second Embodiment

Figure 5:
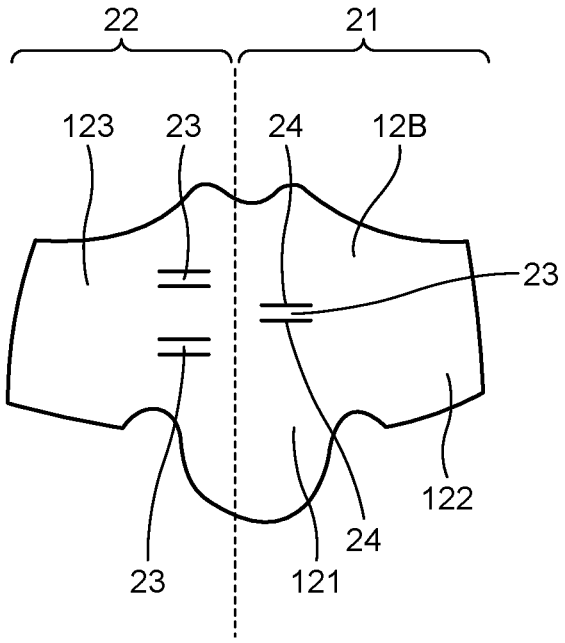
FIG. 5 is a plan view of a shoe component according to a second embodiment.

FIG. 5 is a plan view of a shoe component according to a second embodiment. A shoe component 12B according to the second embodiment is different from the shoe component 12A according to the first embodiment in that one tongue eyelet is formed in a medial-foot tongue portion 21 and two tongue eyelets 23 are formed in a lateral-foot tongue portion 22.

In the shoe component 12B according to the second embodiment, the number of the tongue eyelets 23 of the lateral-foot tongue portion 22 is greater than the number of the tongue eyelets 23 of the medial-foot tongue portion 21. For this reason, when a second part 32 of a shoelace 3 is pulled, the lateral-foot tongue portion 22 is more strongly drawn to the center in the foot width direction than the medial-foot tongue portion 21. Therefore, a shoe 50 using the shoe component 12B according to the second embodiment can hold a foot of a wearer on the lateral foot side more strongly than on the medial foot side when the second part 32 of the shoelace 3 is pulled.

Third Embodiment

Figure 6:
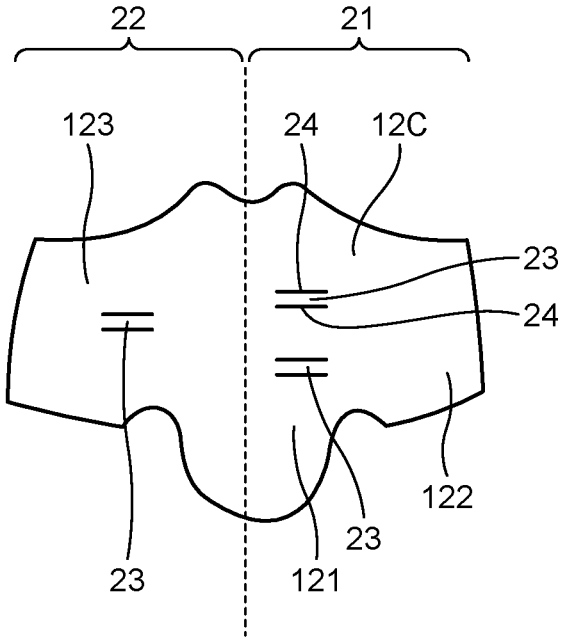
FIG. 6 is a plan view of a shoe component according to a third embodiment.

FIG. 6 is a plan view of a shoe component according to a third embodiment. A shoe component 12C according to the third embodiment is different from the shoe component 12A according to the first embodiment in that a tongue eyelet 23 is provided in a lateral wing 123 of a lateral-foot tongue portion 22.

In the shoe component 12C according to the third embodiment, the tongue eyelet 23 is provided in the lateral wing 123 of the lateral-foot tongue portion 22, and the tongue eyelet 23 of the lateral-foot tongue portion 22 is away from the center in the foot width direction. Therefore, in a shoe 50 using the shoe component 12C according to the third embodiment, when a second part 32 of a shoelace 3 is pulled, the lateral wing 123 of the lateral-foot tongue portion 22 of the shoe component 12C is drawn toward the center in the foot width direction, and the instep of a foot of a wearer is not pressed by a part of the tongue 121 on the lateral foot side from the center in the foot width direction. For this reason, the shoe 50 using the shoe component 12C according to the third embodiment makes the contact with the instep of the foot of the wearer softer and improves the comfort of the wearer.

Fourth Embodiment

Figure 7:
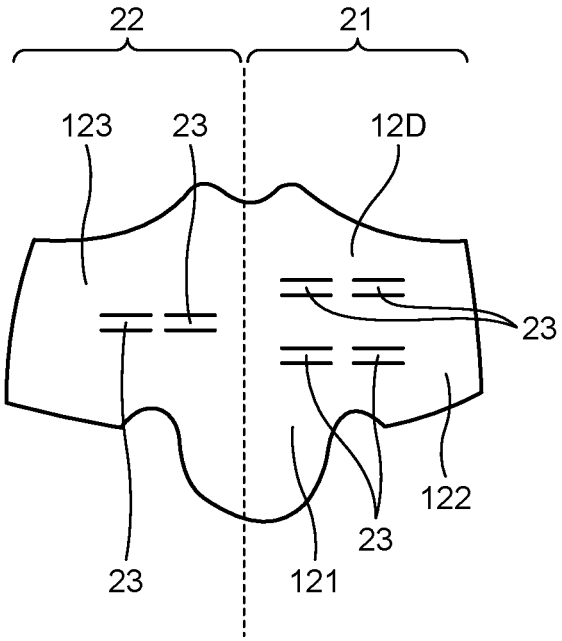
FIG. 7 is a plan view of a shoe component according to a fourth embodiment.

FIG. 7 is a plan view of a shoe component according to a fourth embodiment. In a shoe component 12D according to the fourth embodiment, a plurality of tongue eyelets 23 is provided at positions that are the same in the front-rear direction and different in the foot width direction. Specifically, in the shoe component 12D according to the fourth embodiment, tongue eyelets 23 are provided, in a medial-foot tongue portion 21, side by side in the foot width direction in a part of a tongue 121 on the medial foot side from the center in the foot width direction and in a medial wing 122. In the shoe component 12D according to the fourth embodiment, tongue eyelets 23 are provided, in a lateral-foot tongue portion 22, side by side in the foot width direction in a part of the tongue 121 on the lateral foot side from the center in the foot width direction and in a lateral wing 123.

A shoe 50 using the shoe component 12D according to the fourth embodiment can allow a wearer to select which of the tongue eyelets 23 arranged in the foot width direction to thread a shoelace 3. When the shoelace 3 is threaded through the tongue eyelets 23 close to the center in the foot width direction among the tongue eyelets 23 arranged in the foot width direction, the hold on the instep of the foot of the wearer becomes stronger, and when the shoelace 3 is threaded through the tongue eyelets 23 away from the center in the foot width direction, the hold on the instep of the foot of the wearer becomes weaker. For this reason, the wearer of the shoe 50 using the shoe component 12D according to the fourth embodiment can customize the hold on the instep of the foot. In addition, by changing the tongue eyelets 23 through which the shoelace 3 is threaded in the front-rear direction, it is possible to change the hold on the instep of the foot of the wearer in the front-rear direction. For example, the wearer can customize the hold by making the hold on the instep near the toe weaker and the hold near the ankle stronger.

Fifth Embodiment

Figure 8:
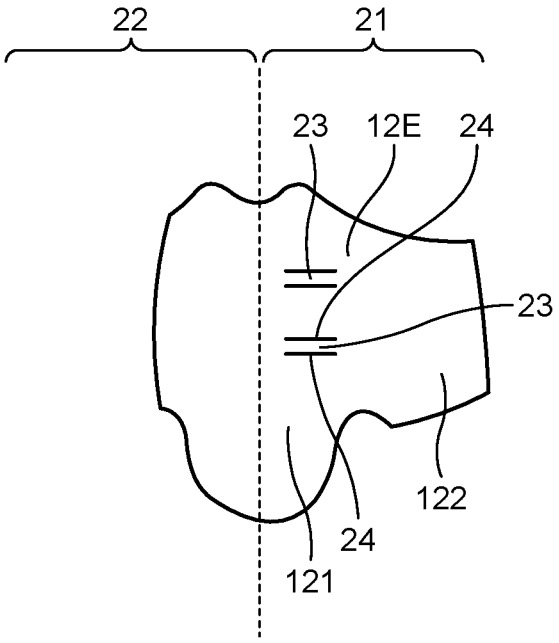
FIG. 8 is a plan view of a shoe component according to a fifth embodiment.

FIG. 8 is a plan view of a shoe component according to a fifth embodiment. A shoe component 12E according to the fifth embodiment is different from the shoe component 12A according to the first embodiment in that it includes a tongue 121 and a medial wing 122 and does not include a lateral wing 123. A shoe 50 using the shoe component 12E according to the fifth embodiment can enhance the hold on the instep of a foot of a wearer on the medial foot side from the center in the foot width direction. Since the shoe component 12E includes no lateral wing 123, the shoe 50 using the shoe component 12E according to the fifth embodiment can reduce the weight.

Here, the shoe component 12E having a structure including the tongue 121 and the medial wing 122 without including the lateral wing 123 has been described, but the shoe component 12E may have a structure including the tongue 121 and the lateral wing 123 without including the medial wing 122. Since the shoe component 12E has a structure including the tongue 121 and the lateral wing 123, the shoe 50 using the shoe component 12E can enhance the hold on the instep of the foot of the wearer on the lateral foot side from the center in the foot width direction.

Sixth Embodiment

Figure 9:
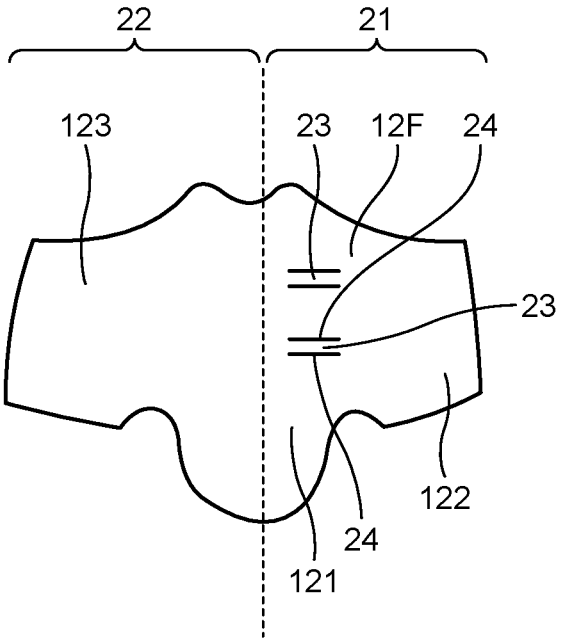
FIG. 9 is a plan view of a shoe component according to a sixth embodiment.

FIG. 9 is a plan view of a shoe component according to a sixth embodiment. A shoe component 12F according to the sixth embodiment is different from the shoe component 12A according to the first embodiment in that tongue eyelets 23 are formed only in a medial-foot tongue portion 21 and no tongue eyelet 23 is formed in a lateral-foot tongue portion 22. In a shoe 50 using the shoe component 12F according to the sixth embodiment, when a second part 32 of a shoelace 3 is pulled, the medial-foot tongue portion 21 is drawn toward the center in the foot width direction, and the shoe component 12F holds the instep of a foot of a wearer on the medial foot side.

In the shoe 50 using the shoe component 12F according to the sixth embodiment, since a lateral wing 123 and a medial wing 122 are fixed to a main upper 11 and an insole similarly to the shoe 50 using the shoe component 12A according to the first embodiment, the position of the shoe component 12F is hardly displaced.

A shoe component according to the present invention has an effect of forming an upper that is highly fitted to a foot of a wearer.

The configurations described in the above embodiments merely show examples of the present invention and can be combined with another known technique, and a part of each configuration can be omitted or changed without departing from the gist of the present invention.

What is claimed is:

1. A shoe component comprising:

a tongue covering an instep of a foot of a wearer;

a medial wing covering a medial midfoot of the wearer; and a lateral wing covering a lateral midfoot of the wearer, wherein a part of the tongue on a medial foot side from a center in a foot width direction and the medial wing constitute a medial-foot tongue portion, a part of the tongue on a lateral foot side from the center in the foot width direction and the lateral wing constitute a lateral-foot tongue portion, the medial-foot tongue portion and the lateral-foot tongue portion are each provided with one or more of a plurality of tongue eyelets through which a shoelace is threaded; and a number of the tongue eyelets provided in the medial-foot tongue portion is different than a number of the tongue eyelets provided in the lateral-foot tongue portion.

2. The shoe component according to claim 1, wherein the medial wing and the lateral wing are seamlessly connected to the tongue.

3. The shoe component according to claim 2, wherein the tongue, the medial wing, and the lateral wing each include an outer surface material serving as an outer surface and an inner surface material serving as an inner surface, and the tongue eyelets are formed by a part of the outer surface material sandwiched between slits formed in parallel in the outer surface material.

4. The shoe component according to claim 3, wherein the slits extends in the foot width direction.

5. The shoe component according to claim 1, wherein the number of the tongue eyelets provided in the medial-foot tongue portion is greater than the number of the tongue eyelets provided in the lateral-foot tongue portion.

6. A shoe comprising:

an upper including the shoe component according to claim 1, and a main upper having a first opening configured to accommodate therein a foot of a wearer and a second opening connected to the first opening in front of the first opening;

a sole attached below the main upper; and a shoelace adjusting an opening/closing degree of the second opening, wherein the second opening has an edge provided with an upper eyelet, the tongue has a front edge fixed to a front edge of the second opening of the main upper, the medial wing and the lateral wing each have a tip fixed to a lower end of a midfoot portion of the main upper and an insole, and the shoelace is threaded alternately through the one or more tongue eyelets provided in the medial-foot tongue portion and the one or more tongue eyelets provided in the lateral-foot tongue portion and then threaded through the upper eyelet.

7. The shoe according to claim 6, wherein the upper eyelet is not provided at the same position at the edge on a medial foot side of the second opening in the front-rear direction as the one or more tongue eyelets provided in the medial-foot tongue portion, and is not provided at the same position at the edge on a lateral foot side of the second opening in the front-rear direction as the one or more tongue eyelets provided in the lateral-foot tongue portion.

8. The shoe according to claim 7, wherein the shoe component has different stretchability from the main upper.

9. The shoe according to claim 6, wherein the shoe component has different stretchability from the main upper.

* * * * *